US005976205A

United States Patent [19]

Andrews et al.

[11] Patent Number: 5,976,205

[45] **Date of Patent: *Nov. 2, 1999**

[54] ABRASIVE TOOL

[75] Inventors: Richard M. Andrews, Westborough, Mass.; Scott Boyle, Hendersonville, N.C.; Robert L. Owen, Horse Shoe, N.C.; Chris S. Poulimenos, Asheville, N.C.; Richard W. Wallahora, Snohomish, Wash.

[73] Assignee: Norton Company, Worcester, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/753,838

[22] Filed: Dec. 2, 1996

[51] Int. Cl.[6] ..... B24D 3/02

[52] U.S. Cl. ..... 51/307; 51/309; 76/DIG. 12; 407/119; 407/32

[58] Field of Search ..... 51/307, 309; 76/DIG. 12; 407/119, 32

[56] References Cited

U.S. PATENT DOCUMENTS

| | | | |
|---|---|---|---|
| 3,178,273 | 4/1965 | Libal | 51/293 |
| 3,596,649 | 8/1971 | Olivieri | 125/11 |
| 3,859,057 | 1/1975 | Stoll et al. | 51/309 |
| 3,894,673 | 7/1975 | Lowder et al. | 228/122 |
| 3,918,138 | 11/1975 | Nemeth et al. | 29/182.7 |
| 4,018,576 | 4/1977 | Lowder | 51/309 |
| 4,225,322 | 9/1980 | Knemeyer | 51/309 |
| 4,527,998 | 7/1985 | Knemeyer | 51/309 |
| 4,685,440 | 8/1987 | Owens | 125/11 |
| 4,731,349 | 3/1988 | Lee et al. | 501/87 |
| 5,011,511 | 4/1991 | Beck | 51/295 |
| 5,178,643 | 1/1993 | Schimweg | 51/293 |
| 5,232,469 | 8/1993 | McEachron et al. | 51/295 |
| 5,385,591 | 1/1995 | Ramanath et al. | 51/309 |
| 5,411,571 | 5/1995 | Kobayashi et al. | 75/232 |
| 5,453,105 | 9/1995 | Middlemiss et al. | 51/307 |
| 5,492,771 | 2/1996 | Lowder et al. | 428/565 |
| 5,505,750 | 4/1996 | Andrews | 51/309 |
| 5,585,175 | 12/1996 | Brandrup et al. | 51/309 |

FOREIGN PATENT DOCUMENTS

| | | | |
|---|---|---|---|
| 1086509 | 7/1977 | Canada | B24D 3/10 |
| 480878 | 8/1991 | European Pat. Off. | B24D 3/06 |
| 580134A1 | 1/1994 | European Pat. Off. | C22C 20/00 |
| 56-029650 | 3/1981 | Japan | C22C 29/00 |
| 60-103148 | 6/1985 | Japan | C22C 29/14 |
| 60-131867 | 7/1985 | Japan | C04B 35/58 |
| 60-169533 | 9/1985 | Japan | C22C 1/05 |

OTHER PUBLICATIONS

Murakawa, Masao; Takeuchi, Sadao; "Forming of a grinding wheel using a dresser with brazed diamond film", *Materials Science & Engineering A: Structural Materials: Properties, Microstructure and Processing vA140 n*, Jul. 7, 1991 pp. 759–763.

Stasyuk, L.F.; Kizikov, E.D.; Kushtalova, I.P.; "Structure and Properties of a Diamond–Containing Composition Material with a Tungsten–Free Matrix for a Truing Tool", *Metal Science and Heat Treatment, v 28 n* Nov.–Dec. pp. 835–839.

Kushtalova, I.P.:Stasyuk, L.F.; Kizikov, E.D.; "Development of a Diamond Containing Material With a Tungsten–Free Matrix for Dressing Tools", *Soviet Journal of Superhard Materials v 8 n 1*, Nov., 1986 pp. 48–51.

*Primary Examiner*—Deborah Jones
*Attorney, Agent, or Firm*—Mary E. Porter

[57] ABSTRACT

The present invention provides a metal bonded abrasive tool wherein the tool has improved life and mechanical properties. The invention further includes the bond composition which allows for improved life and mechanical properties, particularly in diamond blade dressing tools.

23 Claims, 1 Drawing Sheet

ABRASIVE TOOL

BACKGROUND OF THE INVENTION

The invention relates to metal bonded abrasive tools, in particular, diamond dressing tools used to recondition abrasive wheels, and to a novel bond composition which allows for improved mechanical strength and improved abrasive grain retention in the abrasive tools.

To meet the demands of industrial manufacturers, continuous improvements in abrasive retention, bond durability and tool life are a necessity for metal bonded superabrasive tools. Along with the quality of the abrasive grinding tool, the quality of the dressing tool used to recondition the abrasive grinding tool is critical to achieving the desired grinding operation efficiencies and tolerances.

Diamond blade dressers or rotary dressing wheels are used for reconditioning the surfaces of, or generating a profile in grinding wheels. A rotary dresser is used primarily to generate or maintain the shape of abrasive tools having a profiled grinding face. The metal bond composition used in the dressing tool has an enormous impact on dressing tool quality. Metal bonded dressing tools known in the art generally comprise diamond abrasive grain bonded by zinc containing alloys, copper-silver alloys, cobalt alloys, copper, or copper alloys.

Although zinc containing alloys are known for superior bond qualities in metal bonded diamond dressers, they also are known to present disadvantages in manufacturing operations. Zinc is excessively volatile at temperatures used during manufacture of the bonded abrasive tools, resulting in loss of zinc from the bond. This raises the liquidus temperature of the metal bond resulting in the need for a higher manufacturing temperature. The higher temperature further leads to premature furnace lining failure, higher energy costs and potential environmental liabilities.

A near-eutectic copper phosphorus composition described in U.S. Pat. No. 5,505,750 is used in a metal bond for dressing tools. The bond also comprises hard phase particles, such as tungsten, tungsten carbide, cobalt, steel, sol gel alpha-alumina abrasive grain and stellite.

The rotary dressers described in U.S. Pat. No. 3,596,649 are made with a metal powder bond composition comprising tungsten carbide coated diamond grits bonded within in a cobalt matrix. It is theorized that the observed improvements in this tool are due to the relative ease with which the materials adjacent to the diamond grit abrade during use to expose fresh diamond facets for dressing. The previously known 50/50 mixtures of tungsten carbide/cobalt are characterized as yielding a tough matrix immediately adjacent the diamond, resulting in less efficient cutting action.

Abrasive grinding tools described in U.S. Pat. No. 5,385,591 are made with a metal bond comprising a filler with a specified hardness value. The filler consists of certain grades of steel or ceramic. The filler is sintered into the bond, together with the abrasive grain and copper, titanium, silver or tungsten carbide. Preferred bond compositions contain silver, copper and titanium, with the titanium being used to form copper-titanium phases in the sintered bond.

A metal braze composition for a monolayer abrasive tool is described in U.S. Pat. No. 5,492,771 as comprising an alloy or mixture of silver, copper and indium with titanium or other active metal to wet the abrasive grain.

A metal bond for either a monolayer abrasive tool or a metal matrix bond abrasive tool is described in U.S. Pat. No. 5,011,511 as comprising copper silver titanium alloys, or copper titanium alloys, or copper zirconium alloys, copper titanium eutectics and copper zirconium eutectics. During bonding the abrasive grain and the bond components react to form carbides or nitrides.

A nickel alloy bond for rotary dressers formed by an electrolytic plating process is described in U.S. Pat. No. 4,685,440.

Despite the development of these metal bond systems for abrasive tools, there remains a demand for better bonds characterized by a longer tool life, better resistance to abrasion and better abrasive grain bonding.

SUMMARY OF THE INVENTION

The invention is an abrasive tool comprising superabrasive grain and an active metal bond composition, comprising 2–40 wt % active phase, 5–78 wt % hard phase, and 20–93 wt % binder phase selected from the group consisting of cobalt, iron, nickel and their alloys, and combinations thereof, wherein a majority of the superabrasive grain is chemically bonded with at least a portion of the active phase following sintering to form a metal bond. The metal bond may further comprise 0.5 to 20 wt % of an infiltrant phase to densify the metal bond. The infiltrant phase is selected from the group consisting of copper, tin, zinc, phosphorus, aluminum, silver and their alloys and combinations thereof.

The abrasive tool may be a dressing tool or an abrasive grinding tool.

A method for manufacturing the dressing tool of the invention comprises a first sintering step wherein the superabrasive grain is reacted with the active phase of the active metal bond composition to yield a sintered composite, followed by a second step wherein an infiltrant phase is vacuum infiltrated into the sintered composite to form an abrasive tool which is substantially free of porosity.

DETAILED DESCRIPTION OF THE INVENTION

Figure 1:
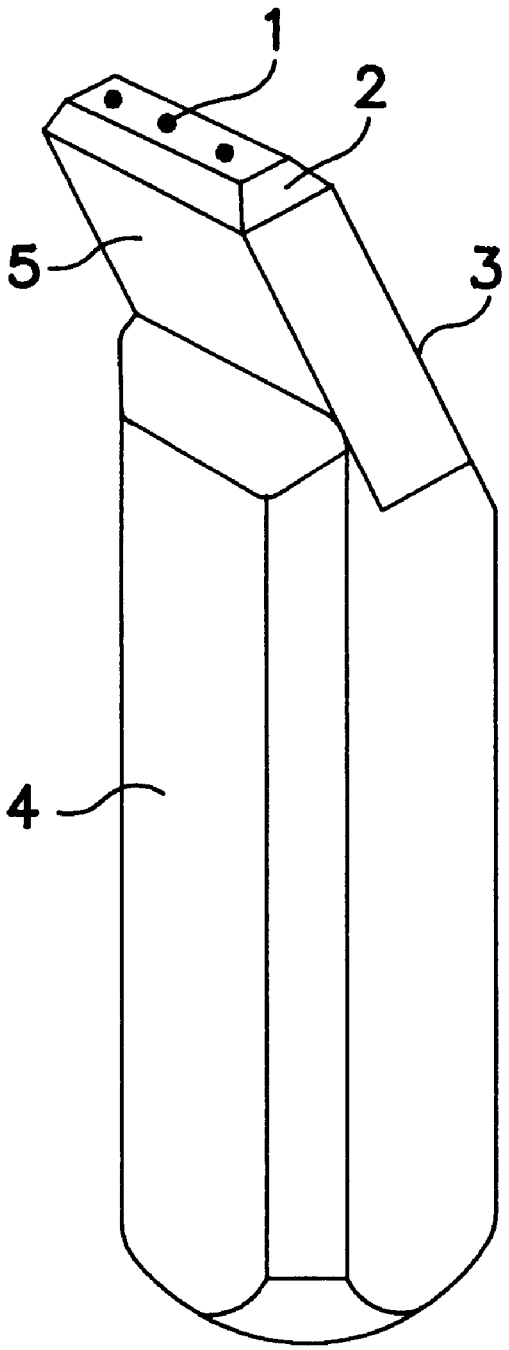
FIG. 1. Schematic illustrating a diamond blade dressing tool of the invention.

The invention is an abrasive tool comprising abrasive particles bonded by a metal bond comprising a hard phase, a binder phase selected from cobalt, iron, nickel, their alloys and combinations thereof, and an active phase consisting of chemical reactants suitable for forming carbide or nitride compositions in combination with diamond or cubic boron nitride abrasives, respectively. The abrasive tools generally comprise a metallic core or shank and the metal bonded abrasive composition which is attached to the metallic core or shank by brazing, infiltration, adhesive bonding, metal bonding or other methods known in the art. In an optional aspect of the invention, the metal bond also may be densified with an infiltrant phase of metals, such as copper, tin, silver, zinc, phosphorus, aluminum, and their alloys and combinations thereof.

The abrasive tool is preferably a dressing tool which is used for generating a profile in and maintaining the free cutting condition of an abrasive grinding tool. A typical dressing tool is shown in FIG. 1. Diamond grains (1) are bonded within a metallic matrix (2) to form the abrasive component (3) of the dressing tool. The abrasive component (3) is attached to a core or shank (4), and a steel or other metal backing element (5) may be present along one or both sides of the abrasive component (4). The core or shank (4)

is used to mount the dressing tool on a machine or to hold the tool in manual operations. The metallic core of the dressing tool may be formed from steel, preferably carbon or stainless steel, or from infiltrated powdered metal where the metal bond used as the infiltrant is the same as that in the abrasive composition, and the powdered metal can be for example tungsten, iron, steel, cobalt or combinations thereof, or from any other material suited for providing mechanical support to the abrasive component of the dressing tool during use.

For the tools of the invention, the particle size of the abrasive grains typically is larger than 325 mesh, and preferably, larger than about 140 mesh. The abrasive grain is a superabrasive substance such as diamond or cubic boron nitride (CBN). Diamond is preferred for dressing tools.

The term "bond composition" is used to designate the composition of the powdered mixture of components which surround and adhere to the abrasive grit. The term "bond" means the densified metal bond after heating or other treating of the bond composition to fix abrasive grains within the metal matrix.

Generally, the bond composition components are supplied in powder form. Particle size of the powder is not critical, however powder smaller than about 325 U.S. Standard sieve mesh (44 $\mu$m particle size) is preferred. The bond composition is prepared by mixing the ingredients, for example, by tumble blending, until the components are dispersed to a uniform concentration.

The hard phase of the bond composition provides abrasion resistance to the abrasive tool. Abrasion resistance maintains the life of the metal bond so the metal bond does not fail before the abrasive grain has been consumed by the dressing or grinding operations. Greater concentrations of hard phase materials are needed in dressing tools which are subject to the abrasive forces encountered during reconditioning of abrasive grinding tools. The hard phase preferably includes tungsten carbide, titanium boride, silicon carbide, aluminum oxide, chromium boride, chromium carbide, and combinations thereof. The hard phase is a metallic carbide or boride or a ceramic material preferably having a hardness of at least 1000 Knoop.

The binder phase of the bond composition must exhibit little reactivity towards the active phase under sintering conditions. The binder phase includes metals such as cobalt, nickel, iron and alloys and combinations thereof.

The active phase must react with the abrasive grain under non-oxidizing sintering conditions to form a carbide or a nitride and thereby securely bond the abrasive grain into the metal bond. The active phase preferably includes materials such as titanium, zirconium, chromium and hafnium, and their hydrides, and alloys and combinations thereof.

Titanium, in a form that is reactive with diamond or CBN, is a preferred active phase component and has been demonstrated to increase the strength of the bond between abrasive and metallic binder. The titanium can be added to the mixture either in elemental or compound form. Elemental titanium reacts with oxygen to form titanium dioxide and thus becomes unavailable to react with diamond during sintering. Therefore, adding elemental titanium is less preferred when oxygen is present. If titanium is added in compound form, the compound should be capable of dissociation during the sintering step to permit the titanium to react with the superabrasive. Preferably titanium is added to the bond material as titanium hydride, $TiH_2$, which is stable up to about 600° C. Above about 600° C., in an inert atmosphere or under vacuum, titanium hydride dissociates to titanium and hydrogen.

A preferred component of the binder phase of the bond composition is cobalt. Cobalt is useful for the toughness of the matrix it forms with a preferred hard phase (e.g., tungsten carbide) and for the paucity of reaction with the active phase. When made with cobalt binder phase, the sintered composite structure of abrasive grain, hard phase and active phase has exceptional mechanical strength and stiffness.

A preferred aspect of the abrasive tools of the invention, particularly of the dressing tools, is the use of an infiltrant phase to fill in the pores of the sintered composite structure. Although many materials may be used for this purpose, copper is preferred. It has been found that the addition of copper or the other preferred infiltrant materials to the bond composition prior to sintering has a deleterious effect on abrasive grain retention in the bond. It is theorized that the copper or other infiltrant is reacting with the active phase and preventing the formation of carbides or nitrides with a majority of the abrasive grain. Thus, metals such as copper, tin, zinc, phosphorus, aluminum, silver and their alloys and mixtures are preferably not added to the bond composition until after the active phase reaction has occurred (i.e., after sintering or other heat treatment to fix the abrasive grain in the bond).

As will be explained below, it is intended to flow the copper into the sintered composition by vacuum infiltration to achieve full density in the metal bonded abrasive tool. Thus, it is important that the copper ingredient be added in a form readily capable of such infiltration. If added as a copper alloy with a diluent, such as aluminum, tin, and silver, the melting range of the alloy will likely be too wide to flow uniformly at heating rates found in most furnace operations. Preferably, the copper ingredient is elemental copper.

For dressing tools which have more demanding bond density and performance requirements than an abrasive grinding tool, the bond composition is preferably about 50–83 wt % hard phase, about 15–30 wt % binder phase, and about 2–40 wt % active phase, more preferably, about 55–78 wt % hard phase, about 20–35 wt % binder phase, and about 2–10 wt % active phase, and most preferably about 60–75 wt % hard phase, about 20–30 wt % binder phase, and about 2–5 wt % active phase.

In a preferred embodiment, the bond composition of the dressing tool comprises a hard phase of tungsten carbide, a binder phase of cobalt and an active phase of titanium hydride. The bond composition is preferably about 50–83 wt % tungsten carbide, about 15–30 wt % cobalt, and about 2–40 wt % titanium hydride, more preferably, about 55–78 wt % tungsten carbide, about 20–35 wt % cobalt, and about 2–10 wt % titanium hydride, and most preferably about 60–75 wt % tungsten carbide, about 20–30 wt % cobalt, and about 2–5 wt % titanium hydride. When the dressing tool bond comprises a copper bond, the infiltrant phase preferably comprises about 5–30 wt % copper, more preferably, about 10–20 wt % copper, and most preferably about 10–15 wt % copper.

For abrasive grinding tools, a preferred bond composition comprises about 5–50 wt % hard phase, about 50–93 wt % binder phase, and about 2–40 wt % active phase, more preferably, about 5–30 wt % hard phase, about 70–90 wt % binder phase, and about 2–10 wt % active phase, and most preferably about 10–20 wt % hard phase, about 80–88 wt % binder phase, and about 2–5 wt % active phase. On a volume percentage basis, the abrasive grinding tools may comprise 0–15% porosity, 10–50% abrasive grain and 50–90% metal bond. As with dressing tools, bond compositions comprising tungsten carbide, cobalt, copper and titanium hydride, with a copper infiltrant, are preferred.

The bond composition for each type of tool also may include minor amounts of additional components such as lubricants (e.g., waxes) or secondary abrasives or fillers or minor amounts of other bond materials known in the art. Generally, such additional components can be present at up to about 5 wt % of the bond composition.

In making the dressing tools, bond composition powders, e.g., tungsten carbide, cobalt and titanium hydride powders are mixed to form a powder blend and then the blend and the abrasive grain are pressed into a die cavity, cold pressed to mold a green composite from the powder and the diamond abrasive grain and sintered under conditions selected to avoid oxidation of the titanium and the diamond and to allow thermal dissociation of the titanium hydride so as to form a composite containing a titanium carbide phase securely bonding the diamond into the metallic phase. The sintering step is generally carried out under vacuum or a non-oxidizing atmosphere at a pressure of 0.01 microns to 1 micron and a temperature of 1150° to 1200° C. In a second step, the sintered composite is vacuum infiltrated with the infiltrant phase to fully densify the abrasive tool and eliminate substantially all porosity. In a preferred tool, the density is at least 95% of the theoretical density for the metal bonded abrasive composite.

In making a dressing tool, a portion of the dry powder bond composition may be added to a mold followed by the abrasive grain and pressed, and then the remainder of the composition can be added to the mold to embed the abrasive grain within the bond. The abrasive grains may deposited in a single layer, i.e., substantially, one grain thick, and spaced in a pattern dictated by the specifications for the dressing tool.

Other methods known in the art may be used to manufacture the abrasive tools. For example, hot press equipment may be used to consolidate and densify the materials in place of a cold press consolidation and sintering process. If the hot pressing is done under vacuum, it is usually not necessary to infiltrate the composite to achieve full density.

One skilled in the art will recognize that the quantity of titanium in the active phase should be increased when bonding CBN rather than diamond, due to the relative reactivity of these materials in combination. Quantities of other phases of the bond can be adjusted in a similar manner to accommodate various components of the abrasive tool composition. Accordingly, the invention is not intended to be limited by the particular examples provided herein.

When manufacturing rotary dressers in a conventional manner in a graphite mold, it is difficult to achieve the optimum pressures for bringing the active phase into direct contact with the diamond so as to maximize bond formation. Thus, the method of the invention is preferred for the manufacture of dressing tools having simple, flat shapes, i.e., dressing blades or nibs, rather than circular or complex shapes.

EXAMPLES

Example 1

Dressing blade samples were made according to the invention for testing and comparing to commercial dressing blades in a manufacturing setting.

A mixture of metal powders containing 72 wt % tungsten carbide, 24 wt % cobalt (provided as DM75 by Kennemetal Inc.) and 4 wt % titanium hydride (provided by Cerac Inc.) was divided into two portions. Sixty five grams of the mix was hand tapped at room temperature into a blade shape die cavity having the dimensions (10 mm×10 mm). West African Round Diamonds of 0.029" median diameter were then set into the bond powder in eight rows and eight columns onto the loosely pressed powder in a single layer with the rows of diamond offset by 11 degrees from a line perpendicular to the sides of the blade. The remaining 80 g of the powdered bond mixture was pressed at room temperature and about 870 MPa (63 tsi) over the diamond layer in the die cavity. The resulting green composite of diamonds and bond mixture was sintered in a graphite fixture for 30 minutes at 1200° C. under a full vacuum ($10^{-4}$ Torr). Following sintering, the composite was vacuum infiltrated with copper (8–12 wt % of bond mixture) at 1130° C. under a nitrogen partial pressure of 400–500 microns for a period of 30 minutes. The finished abrasive blade was fully densified, contained essentially no porosity, had excellent diamond bond characteristics and had a 25–30 HRc hardness. The finished abrasive blade was brazed to a steel shank to form the dressing tool of a configuration common in the grinding industry. The abrasive blade thus produced has sufficient mechanical strength to permit the omission of the steel backing layer of the sort typically used to construct diamond dressing tool blades known in the art.

The diamond blade dressing tools of the invention were used to recondition a vitrified bond sol gel alumina wheel (5SG60-KVS) installed in a commercial metal part grinding operation. Two commercial diamond blade dressing tools comprising the same diamond grit size and the same blade size were compared to the tools of the invention using the same wheels in the same commercial metal part grinding operation. Results are shown below.

TABLE I

Tool Wear Rate

| Sample | Invention | Commercial Blade 1 | Commercial Blade 2 |
|---|---|---|---|
| Blade Wear cm (in) | 0.221 (0.087) | 0.384 (0.151) | 0.246 (0.097) |
| Wheel Wear cm3 (in3) | 5129 (313) | 2179 (133) | 2950 (180) |
| Wear Ratio | 3600 | 880 | 1856 |

The tool life of the invention was about 4.0 times the tool life of commercial blade 1 and about 1.9 times the tool life of commercial blade 2 when used to recondition abrasive wheels under identical manufacturing conditions. The wear ratio (volume (in 3) of wheel removed per inch of blade consumed during dressing) of the invention was significantly better than the wear ratio of the commercial blades.

It is understood that various other modifications will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

We claim:

1. An abrasive tool comprising superabrasive grain and an active metal bond composition, wherein the active metal bond composition comprises 2–40 wt % active phase, 5–78 wt % hard phase, and 20–93 wt % of a binder phase selected from the group consisting of cobalt, iron, nickel and their alloys, and combinations thereof, and wherein a majority of the superabrasive grain is chemically bonded with at least a portion of the active phase during sintering to form a metal bond.

2. The abrasive tool of claim 1 wherein the active phase is a compound suitable for reacting with the superabrasive grain under a non-oxidizing atmosphere at temperatures of 700–1300° C. to form a product selected from the group consisting of carbide and nitride compounds.

3. The abrasive tool of claim 1 wherein the active phase is selected from the group consisting of titanium, zirconium, hafnium, chromium, their hydrides, and alloys and combinations thereof.

4. The abrasive tool of claim 1, wherein the hard phase is a ceramic material having a Knoop hardness of at least 1000 $Kg/mm^2$.

5. The abrasive tool of claim 4, wherein the hard phase is selected from the group consisting of tungsten carbide, titanium boride, silicon carbide, aluminum oxide, chromium carbide, chromium boride, and combinations thereof.

6. The abrasive tool of claim 1, wherein the metal bond further comprises 0.5 to 20 wt % of an infiltrant.

7. The abrasive tool of claim 6, wherein the infiltrant phase is selected from the group consisting of copper, tin, zinc, phosphorus, aluminum, silver and their alloys and combinations thereof.

8. A dressing tool for reconditioning grinding tools, comprising superabrasive grain and an active metal bond composition, wherein the active metal bond composition comprises 2–40 wt % active phase, 50–83 wt % hard phase, and 15–30 wt % of a binder phase selected from the group consisting of cobalt, iron, nickel and their alloys, and combinations thereof, and wherein a majority of the superabrasive grain is chemically bonded with at least a portion of the active phase during sintering to form a metal bond.

9. The abrasive tool of claim 8, wherein the superabrasive grain and the active metal bond composition form a chemically bonded composite structure during sintering, and the composite structure has sufficient mechanical strength and stiffness to be a structural component of the dressing tool in the absence of a mechanical backing element.

10. The abrasive tool of claim 8, wherein the active metal bond composition of the dressing tool is substantially free of porosity and has a density of at least 95% of theoretical.

11. The abrasive tool of claim 8, wherein the active metal bond composition of the dressing tool comprises 2–40 wt % active phase, 50–83 wt % hard phase, and 15–30 wt % binder phase.

12. The abrasive tool of claim 8, wherein the active metal bond of the dressing tool comprises 2–10 wt % active phase, 65–80 wt % hard phase, and 25–35 wt % binder phase.

13. The abrasive tool of claim 8, wherein the active metal bond of the dressing tool comprises 2–5 wt % active phase, 60–75 wt % hard phase, and 20–30 wt % binder phase.

14. The abrasive tool of claim 8, wherein the active phase comprises titanium hydride, the hard phase comprises tungsten carbide, the binder phase comprises cobalt, and the metal bond further comprises 5–30 wt % of a copper infiltrant.

15. The abrasive tool of claim 1, wherein the abrasive tool is a grinding tool.

16. The abrasive tool of claim 15, wherein the grinding tool comprises a maximum of 15 volume % porosity.

17. The abrasive tool of claim 15, wherein the active metal bond composition of the grinding tool comprises 2–40 wt % active phase, 5–50 wt % hard phase, and 50–93 wt % binder phase.

18. The abrasive tool of claim 15, wherein the active metal bond composition of the grinding tool comprises 2–10 wt % active phase, 5–30 wt % hard phase, and 70–90 wt % binder phase.

19. The abrasive tool of claim 15, wherein the active metal bond composition of the grinding tool comprises 2–5 wt % active phase, 10–20 wt % hard phase, and 80–88 wt % binder phase.

20. The abrasive tool of claim 15, wherein the active phase comprises titanium hydride, the hard phase comprises tungsten carbide and the binder phase comprises cobalt.

21. The abrasive tool of claim 15, wherein the metal bond further comprises a copper infiltrant phase.

22. The abrasive tool of claim 1 wherein the active metal bond composition further comprises at least one filler, lubricant or secondary abrasive.

23. A method of manufacturing a dressing tool, comprising the steps:

a) providing a powder mixture of an active metal bond composition consisting of 2–40 wt % of an active phase, 50–88 wt % of a hard phase and 10–30 wt % of a binder phase selected from the group consisting of cobalt, nickel, iron, and alloys and combinations thereof;

b) pressing a portion of the mixture into a die cavity formed in the shape of the dressing tool;

c) setting superabrasive grain in a desired pattern into the pressed mixture;

d) pressing the remaining portion of the mixture into the die cavity over the superabrasive grain;

e) sintering the bond mixture and the superabrasive grain in the die cavity at 1150° to 1200° C., under vacuum at 1.0 to 0.1 microns Hg pressure to form a composite structure;

f) infiltrating the composite structure under vacuum with 10–30%, on a powder mixture weight basis, of an infiltrant phase selected from the group consisting of copper, tin, zinc, phosphorus, aluminum, silver and their alloys and combinations thereof, until essentially all void volume within the composite structure has been filled with infiltrant phase;

whereby the active phase is chemically reacted with the superabrasive grain prior to infiltration and the dressing tool is substantially free of porosity.

* * * * *